US005088429A

United States Patent [19]

Kanegae

[11] Patent Number: 5,088,429

[45] Date of Patent: Feb. 18, 1992

[54] SEWING MACHINE INDIVIDUALLY DRIVING NEEDLE BAR AND LOOPER

[75] Inventor: Takahiro Kanegae, Nagoya, Japan

[73] Assignee: Brother Kogyo Kabushiki Kaisha, Nagoya, Japan

[21] Appl. No.: 610,111

[22] Filed: Nov. 7, 1990

[30] Foreign Application Priority Data

Feb. 13, 1990 [JP] Japan ..... 2-31833

[51] Int. Cl.[5] ..... D05B 69/10

[52] U.S. Cl. ..... 112/275; 112/220; 112/221

[58] Field of Search ..... 112/220, 221, 275, 181, 112/182, 184, 121.11

[56] References Cited

U.S. PATENT DOCUMENTS 3,425,376 2/1969 Brynge et al. ..... 112/220
3,875,489 4/1975 Von Brimer ..... 112/220 X
4,620,497 11/1986 Sano ..... 112/275 X
4,690,081 9/1987 Castagna et al. ..... 112/220 X

FOREIGN PATENT DOCUMENTS 57-28594 2/1982 Japan .
2-218389 8/1990 Japan ..... 112/275

*Primary Examiner*—Peter Nerbun
*Attorney, Agent, or Firm*—Oliff & Berridge

[57] ABSTRACT

A sewing machine having separate drives for the needle bar and looper includes initialization routines to place the needle bar and looper in predetermined starting positions prior to the start of a sewing operation. Position detectors comprise photoelectric cells and interrupters mounted on the motor shafts of the needle bar drive motor and the looper drive motor. The position of the needle bar is initialized first, by movement in a reverse direction, if necessary, to prevent undesired engagement with the looper. Thereafter, the looper position is initialized. A sewing operation is enabled once the needle bar and looper are set in predetermined starting position.

14 Claims, 6 Drawing Sheets

SEWING MACHINE INDIVIDUALLY DRIVING NEEDLE BAR AND LOOPER

BACKGROUND OF THE INVENTION

1. Field of the Invention

The present invention relates to a sewing machine provided with a needle bar and a looper which are driven respectively by individual actuators.

2. Discussion of the Related Art

A conventional electric sewing machine is provided with a single motor for driving both an arm shaft for vertically moving a needle bar, and a lower shaft for rotating a looper. In such a conventional electric sewing machine with a single motor, the motor drives the arm shaft, and the rotation of the upper shaft is transmitted through a transmission mechanism to the lower shaft.

The transmission mechanism interlocking the arm shaft and the lower shaft places restrictions on the general basic construction and design of the electric sewing machine. Furthermore, the transmission mechanism requires much time and labor for fine adjustment in assembling the same so that the arm shaft and the lower shaft operate synchronously to enable the looper to catch a loop of a needle thread.

A sewing machine proposed to deal with such problems is provided with individual motors respectively for driving the arm shaft and the lower shaft.

In this sewing machine with individual motors, the arm shaft and the lower shaft are mechanically independent of each other, and the arm shaft and the lower shaft are driven individually by a needle-bar driving system and a lower-shaft driving system, respectively. Accordingly, if the needle-bar driving system or the lower-shaft driving system is moved unnecessarily by vibrations (for example, as may occur when the sewing machine is moved) or the like before the electric sewing machine is connected to a power source, the positional relation between the needle bar and the looper is disturbed and, consequently, the looper is unable to catch a loop of the needle thread or the looper interferes with the needle so that the electric sewing machine is unable to form stitches.

SUMMARY OF THE INVENTION

Accordingly, it is an object of the present invention to provide a sewing machine provided with a needle bar and a looper which are driven respectively by individual motors, capable of correcting the positional relation between the needle bar and the looper before starting the sewing operation to achieve normal sewing operation even if the positional relation between the needle bar and the looper is disturbed by vibrations or the like.

To achieve the object, the present invention provides a sewing machine comprising: a vertically moving needle bar fixedly holding a needle at its lower end; a looper for forming stitches in cooperation with the needle; a needle bar actuator for driving the needle bar; a looper actuator for driving the looper; needle position detecting means for detecting the position of the needle bar; looper position detecting means for detecting the position of the looper; and initial state setting means for setting the needle bar and the looper respectively at predetermined initial positions by controlling the needle bar actuator and the looper actuator according to the position of the needle bar detected by the needle position detecting means and the position of the looper detected by the looper position detecting means.

In the sewing machine thus constructed in accordance with the present invention, the initial state setting means controls the needle bar actuator to drive the needle bar, and stops the needle bar actuator upon the detection of arrival of the needle bar at the predetermined initial position by the needle bar position detecting means. The initial state setting means controls the looper actuator to drive the looper, and stops the looper actuator upon the detection of arrival of the looper at the predetermined initial position by the looper position detecting means.

Since the initial state setting means of the sewing machine of the present invention corrects the respective positions of the needle bar and the looper when the needle bar and the looper are not in the correct positional relation in order that the correct positional relation between the needle bar and the looper is established, the sewing machine is always able to perform normal sewing operation.

BRIEF DESCRIPTION OF THE DRAWINGS

Preferred embodiments of the present invention will be described in detail with reference to the accompanying drawings, wherein.

DETAILED DESCRIPTION OF THE PREFERRED EMBODIMENTS

Figure 1:
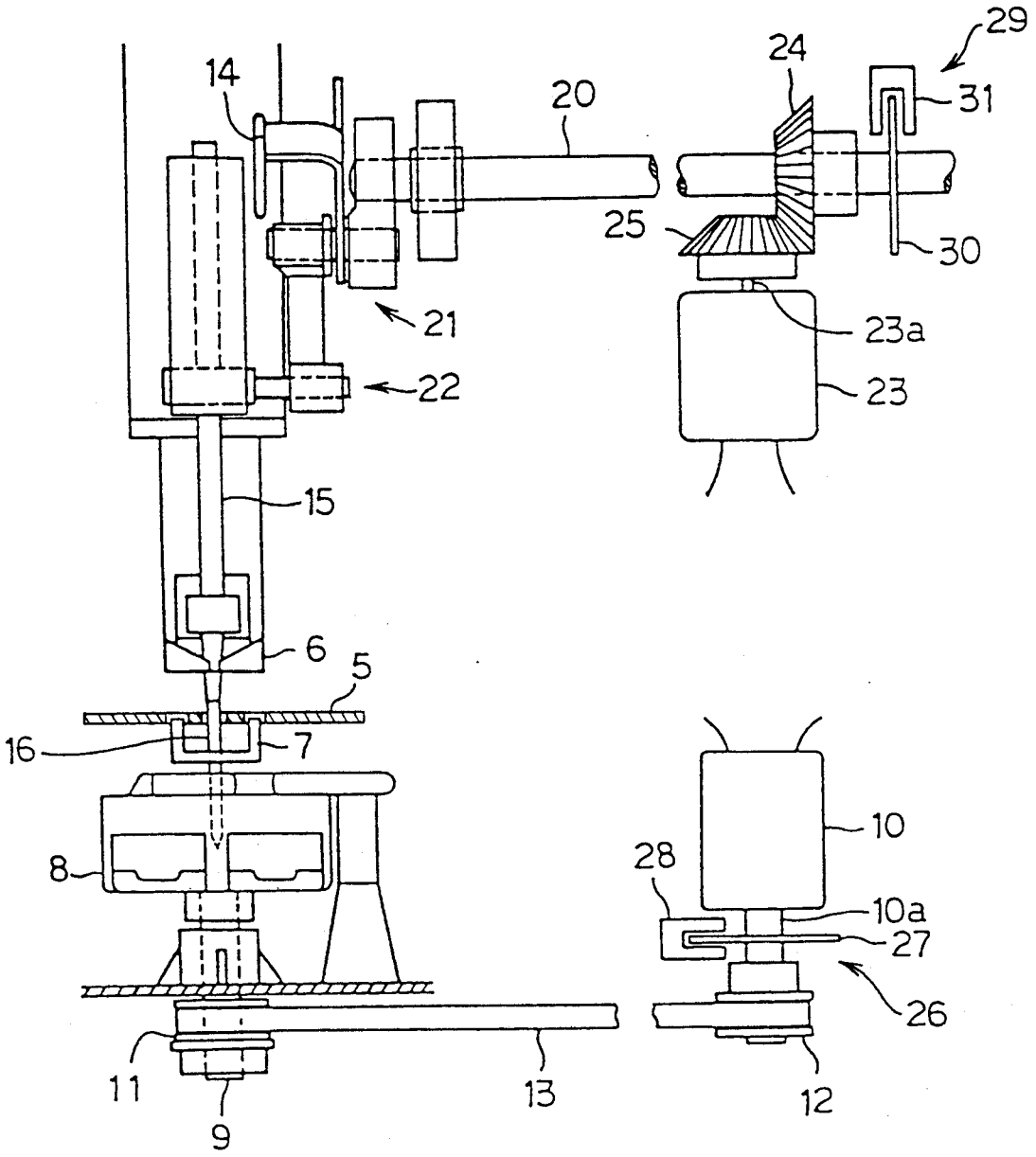
FIG. 1 is a sectional view of an essential portion of a sewing machine in a preferred embodiment according to the present invention.

A sewing machine in a preferred embodiment according to the present invention will be described hereinafter. As shown in FIG. 2, the sewing machine has a machine body comprising a bed 1, an arm 3 provided with a head 2, and a post 4 supporting the arm 3 on the bed 1. A throat plate 5 (FIG. 1) is placed on the upper surface of the bed 1. A presser foot 6 for pressing a workpiece against the throat plate 5 is vertically movably supported on the head 2.

Figure 2:
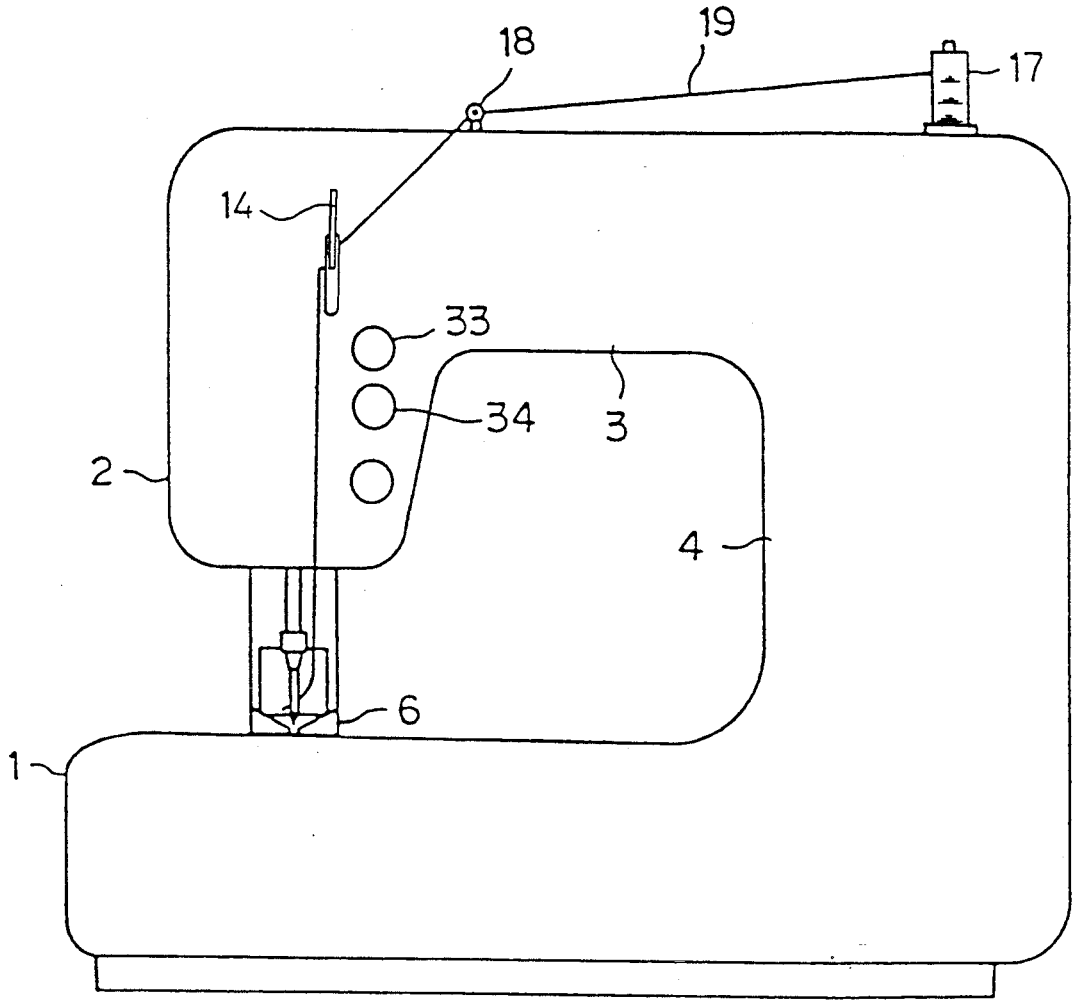
FIG. 2 is a schematic front view of the sewing machine of FIG. 1.

As shown in FIG. 1, a feed dog 7 for feeding the workpiece placed on the throat plate 5 is disposed within the bed 1, and a rotary hook 8, i.e., a looper, containing a bobbin, not shown, on which a bobbin thread is wound is disposed under the feed dog 7. The rotary hook 8 is rotated by a vertical lower shaft 9 perpendicular to the throat plate 5 and is driven by a lower shaft driving motor 10 such as a reversible dc motor. Timing belt pulleys 11 and 12 are attached respectively to the lower shaft 9 an the output shaft 10*a* of the lower shaft driving motor 10, and a timing belt 13 is extended between the timing belt pulleys 11 and 12. The feed dog 7 is driven through a linkage, not shown, by the lower shaft 9. The feed dog 7 may also be driven through a linkage by an individual motor.

The head 2 supports a thread takeup lever 14 for vertical swing motion and a needle bar 15 for vertical reciprocation. A needle 16 is fastened to the lower end of the needle bar 15 projecting from the lower end of the head 2. As shown in FIG. 2, a needle thread 19 pulled out from a spool 17 is extended through a thread tension regulator 18 and an eyelet formed in the extremity of the thread takeup lever 14 projecting from the front surface of the head 2 and is passed through the eye of the needle 16. The thread takeup lever 14 and the needle bar 15 are driven by an arm shaft 20 extended longitudinally of and within the arm 3 respectively through a linkage 21 and a crank mechanism 22. The arm shaft 20 is driven by an arm shaft driving motor 23 such as a reversible dc motor. Meshed bevel gears 24 and 25 are attached respectively to the arm shaft 20 and the output shaft 23*a* of the arm shaft driving motor 23.

Figure 3:
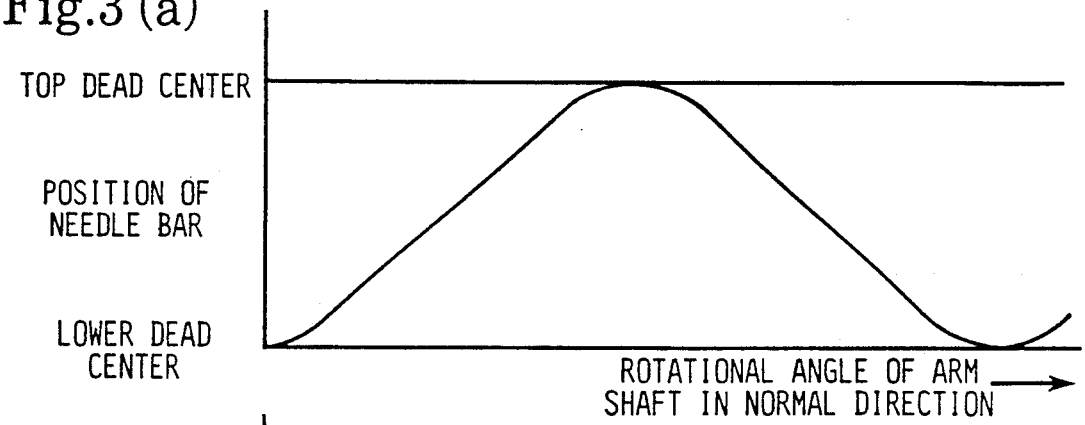
FIGS. 3(*a*), 3(*b*) and 3(*c*) are graphical illustrations showing the conditions of a needle position detector and a looper position detector relative to the position of the needle bar.
Figure 3:
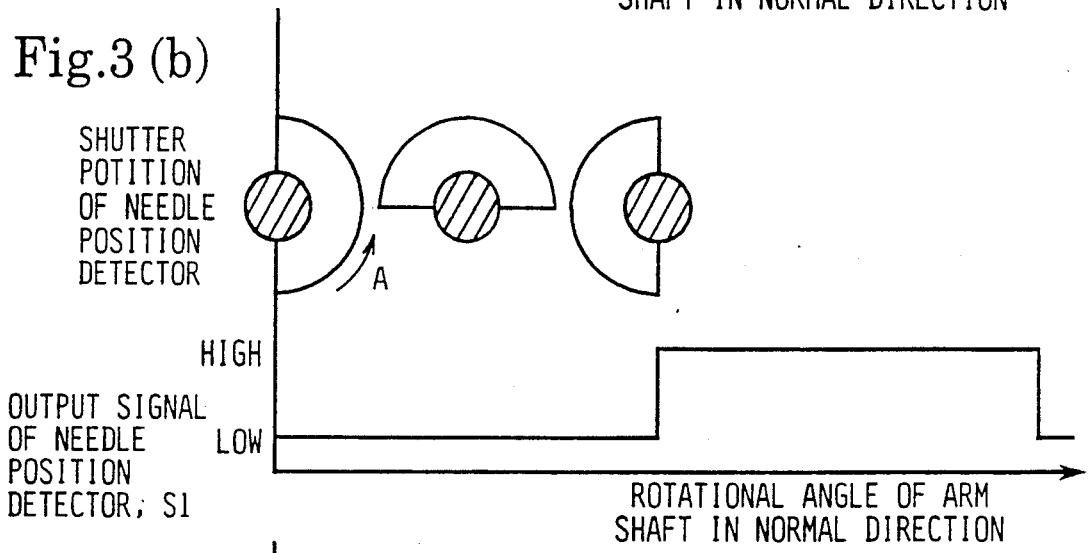
Figure 3:
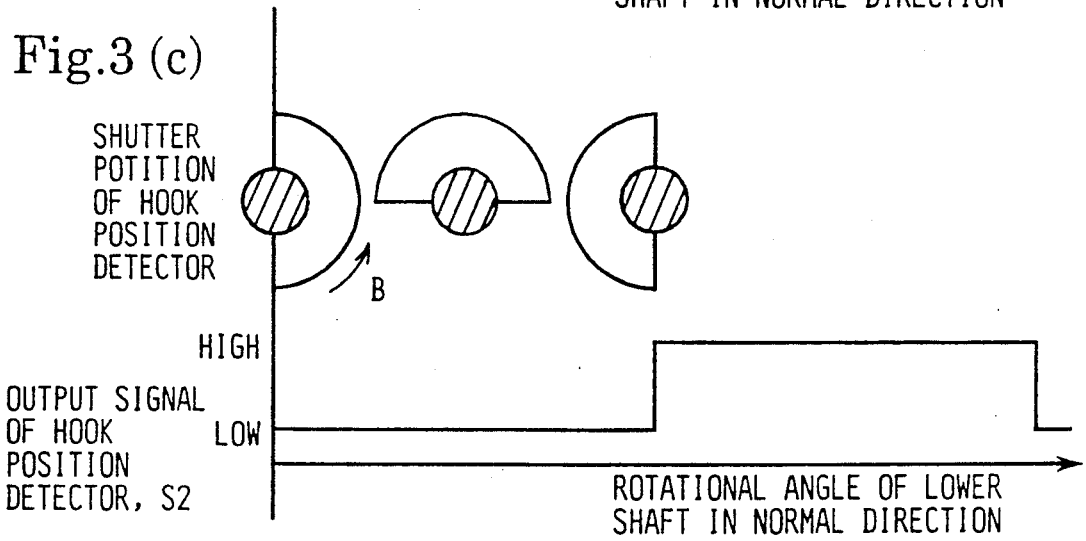

A driving system for driving the rotary hook 8 is provided with a hook position detector 26 to detect the angular position of the rotary hook 8 through the detection of the angular position of the output shaft 10*a* of the lower shaft driving motor 10. The hook position detector 26 comprises a semicircular shutter 27 attached to the output shaft 10*a*, and a photoelectric interrupter 8 fixedly provided within the bed 1. A needle bar driving system for driving the needle bar 15 is provided with a needle position detector 29 to detect the vertical position of the needle bar 15 through the detection of the angular position of the arm shaft 20. The needle position detector 29 comprises a semicircular shutter 30, a photoelectric interrupter 31 fixedly provided within the arm 3. The timing of the output signals of the photoelectric interrupters 28 and 31 while the sewing machine is in operation is shown in FIG. 3. While the sewing machine is in operation, the lower shaft driving motor 10 and the arm shaft driving motor 23 rotate synchronously in the normal direction, and the shutters 27 and 30 rotate in directions indicated by arrows A and B shown in FIGS. 3(*b*) and 3(*c*), respectively. The needle bar 15 and the rotary hook 8 rotate synchronously, maintaining the predetermined positional relation and, consequently, the rotary hook 8 catches a loop of the needle thread 19 and passes the bobbin thread through the loop of the needle thread 19 as the needle 16 is lifted from its bottom dead center. The respective output signals of the photoelectric interrupters 28 and 31 go HIGH (represented by "1" hereinafter) upon the arrival of the rising needle bar 15 at the top dead center, and the same go LOW (represented by "0" hereinafter) upon the arrival of the lowering needle bar 15 at its lower dead center.

Figure 4:
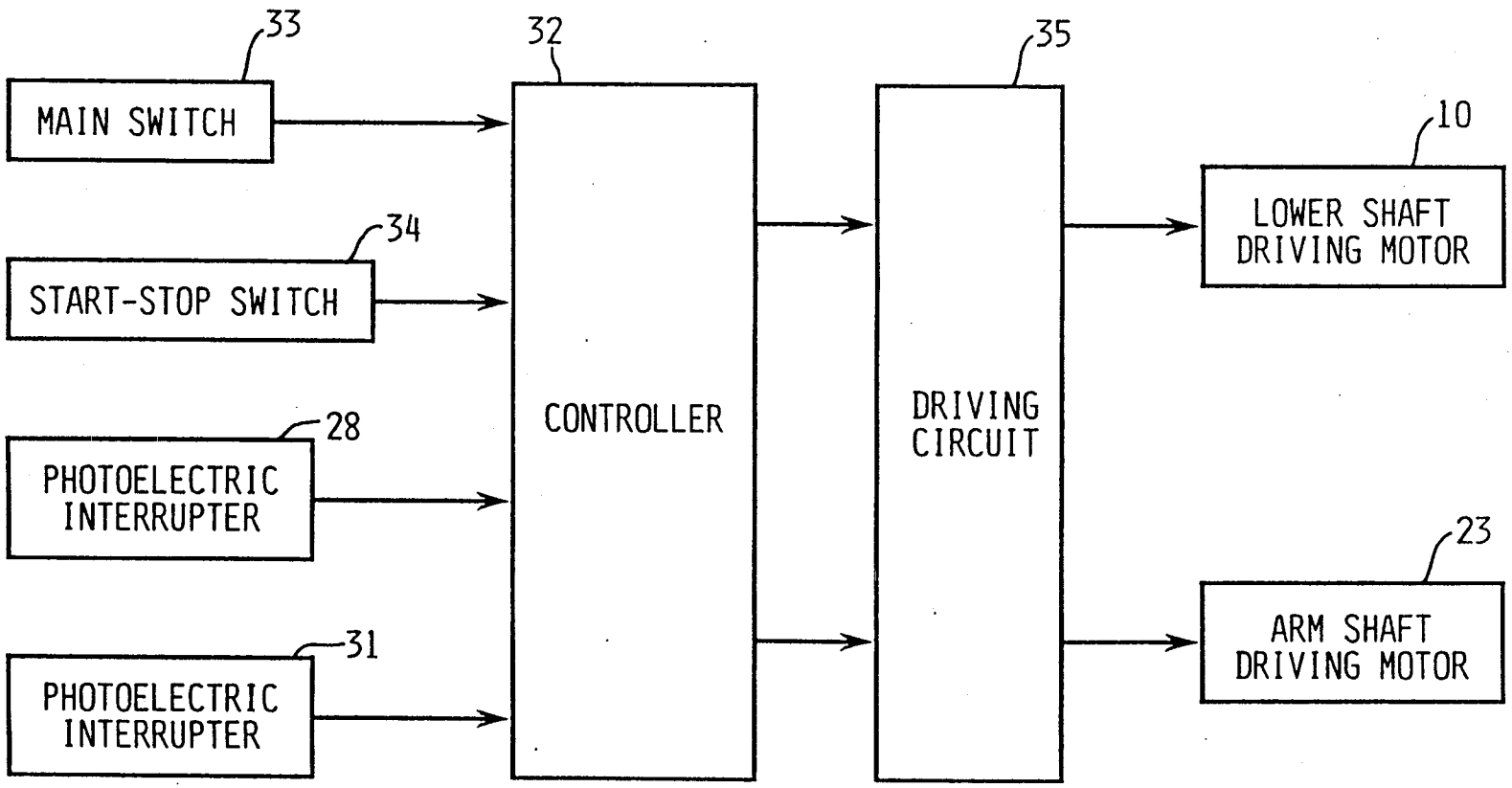
FIG. 4 is a block diagram of an electrical system incorporated into the sewing machine of FIG. 1.

The sewing machine thus constructed is controlled by a controller 32 shown in FIG. 4 having a microcomputer as a principal component. A main switch 33 provided on the head 2, a start-stop switch 34 and the photoelectric interrupters 28 and 31 are connected to the controller 32 to give input signals to the controller 32. The controller 32 controls the motors 10 and 23 through a driving circuit 35 on the basis of the input signals given thereto and a control program stored beforehand in a memory.

The control operation of the controller 32 mainly for setting the rotary hook 8 and the needle bar 15 at their initial positions will be described hereinafter.

Figure 5:
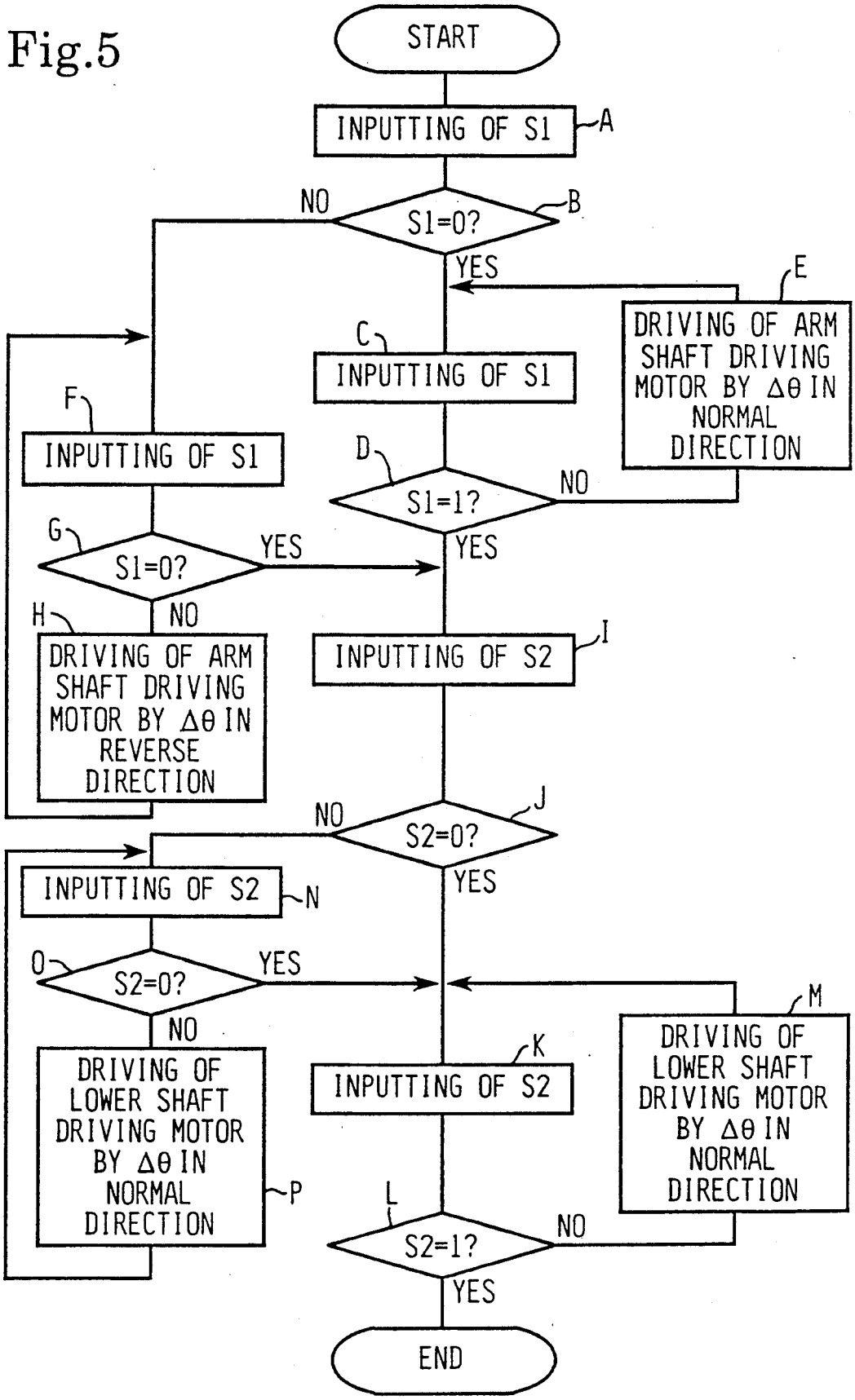
FIG. 5 is a flow chart of an initial state setting operation for setting the needle and the looper respectively at their initial positions.

When the main switch 33 is closed, the controller 32 is reset to start an initial state setting program shown in FIG. 5. First, the controller 32 receives the output signal of the photoelectric interrupter 31 of the needle position detector 29, hereinafter referred to as output signal S1, in step A. When the decision made in step B is affirmative, namely, when the output signal S1 of the photoelectric interrupter 31 is 0, the controller 32 drives the arm shaft driving motor 23 repeatedly for rotation through a minute angle $\Delta\theta$ in the normal direction until the output signal S1 of the photoelectric interrupter 31 goes 1 (steps C, D and E). When the decision made in step B is negative, namely, when the output signal S1 of the photoelectric interrupter 31 is 1, the controller 32 drives the arm shaft driving motor 23 repeatedly for rotation through the minute angle $\Delta\theta$ in the reverse direction until the output signal S1 of the photoelectric interrupter 31 goes 0 (steps F, G and H). Upon the change of the output signal S1 of the photoelectric interrupter 21 from 0 to 1 while the arm shaft driving motor 23 is being driven for rotation in the normal direction, namely, when the decision in step D is affirmative, the controller 32 stops the arm shaft driving motor 23. Upon the change of the output signal S1 of the photoelectric interrupter 31 from 1 to 0 while the arm shaft driving motor 23 is rotating in the reverse direction, namely, the decision made in step G is affirmative, the controller 32 stops the arm shaft driving motor 23. Consequently, the needle bar 15 is moved to and held at the top dead center.

The arm shaft driving motor 23 is driven for rotation in the reverse direction when the output signal S1 of the photoelectric interrupter is 1 because of the following reason. As is obvious from FIG. 3, since the needle bar 15 is in movement from the top dead center toward the bottom dead center when the output signal S1 of the photoelectric interrupter 31 is 1, the needle bar 15 must pass the bottom dead center before reaching the top dead center if the arm shaft driving motor 23 is driven for rotation in the normal direction. In such a case, it is possible that the needle 16 interferes with the rotary hook 8 thereby breaking the needle 16 depending on the position of the rotary hook 8. Therefore, the arm shaft driving motor 23 is driven for rotation in the reverse direction to avoid the needle 16 interfering with the rotary hook 8.

After shifting the needle bar 15 to the top dead center, the controller 32 receives the output signal of the photoelectric interrupter 28 of the hook position detector 26, hereinafter referred to as output signal S2, in step I. When the output signal S2 of the photoelectric interrupter 28 is 0, namely, when the decision made in step J is affirmative, the controller 32 repeats steps K, L and M to drive the lower shaft driving motor 10 for rotation in the normal direction until the output signal of the photoelectric interrupter 28 goes 1. Upon the change of the output signal S2 of the photoelectric interrupter 31 from 0 to 1, namely, when the decision made in step L is affirmative, the controller 32 stops the lower shaft driving motor 10 and ends the operation for executing the initial state setting program. When the output signal S2 received in step I is 1, namely, when the decision made in step J is negative, the controller 32 repeats steps N, 0 and P to drive the lower shaft driving motor 10 for rotation in the normal direction until the output signal S2 of the photoelectric interrupter 28 goes 1. Upon the change of the output signal S2 from 0 to 1, namely, when the decision made in step L is affirmative, the controller 32 stops the lower shaft driving motor 10 and ends the execution of the initial state setting program. Thus, the rotary hook 8 is turned to and stopped at the initial position corresponding to the top dead center of the needle bar 15 (the needle 16).

Thus, the initial state setting program is executed, immediately after the main switch 33 has been closed, to adjust the respective positions of the rotary hook 8 and the needle bar 15 to their regular initial positions so that the predetermined positional relation between the rotary hook 8 and the needle bar 15 is established, and the rotary hook 8 and the needle bar 15 are able to carry out the normal sewing operation. Since the rotary hook 8 is turned after the needle bar 15 has been shifted to the top dead center in setting the initial state, the rotary hook 8 never interferes with the needle 16 when turned.

After the start-stop switch 34 has been operated to start the sewing machine, the motors 10 and 23 are driven in a feedback control mode so that the predetermined positional relation is maintained for the normal sewing operation.

The present invention is not limited to the foregoing embodiment in its practical application and many changes and variations are possible therein without departing from the scope and spirit thereof.

For example, the initial position of the needle bar 15 is not limited to its top dead center; the initial position of the needle bar 15 may be any position provided that the needle 16 is positioned above the throat plate 5. When the initial position of the needle bar 15 is changed properly, the initial position of the rotary hook 8 is changed accordingly. The initial state setting program may be executed after the start-stop switch 34 has been closed and before the sewing operation is started.

Figure 6:
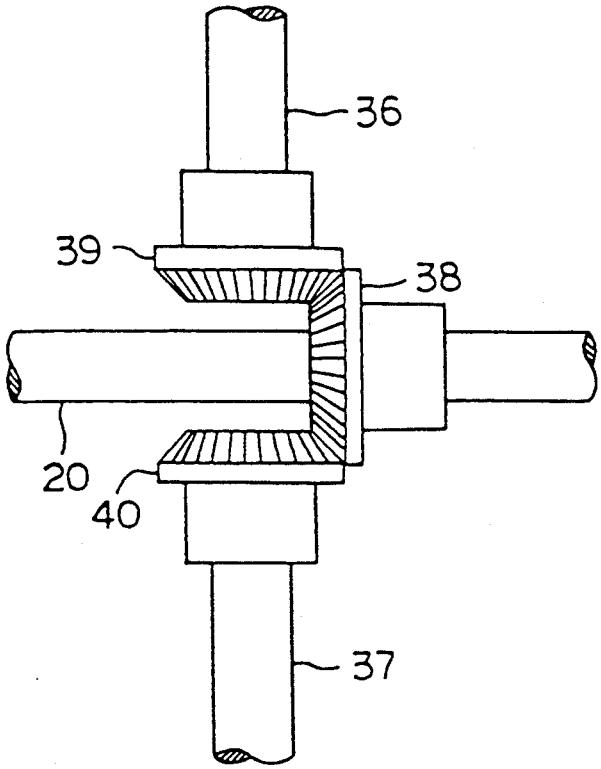
FIG. 6 is a fragmentary side view of a mechanism for rotating the arm shaft in opposite directions employed in a sewing machine in another embodiment according to the present invention.

Furthermore, when motors each capable of rotating only in one direction are employed instead of the reversible arm shaft driving motor 23, the arm shaft 20 may be interlocked with the respective output shafts 36 and 37 of the two motors by bevel gears 38, 39 and 40 as shown in FIG. 6, and one of the two motors may be actuated to turn the arm shaft 20 in the normal direction and the other may be actuated to turn the arm shaft 20 in the reverse direction.

What is claimed is:

1. Positional control means for a sewing machine comprising:

a reciprocable needle bar movable between a top position and a lower position;

a looper for forming stitches in cooperation with a needle mounted on the needle bar;

first drive means for driving the needle bar;

second drive means for driving the looper;

means for controlling the first and second drive means for the needle bar and the looper, said controlling means including means for permitting stitch formation operation of the needle bar and the looper only when the needle bar and looper are in predetermined relationship prior to the start of the stitch formation operation.

2. Apparatus as in claim 1, comprising:

means for detecting the position of the needle bar;

means for detecting the position of the looper; and said controlling means includes means for receiving inputs from the needle bar position detecting means and the looper position detecting means.

3. Apparatus as in claim 2, wherein the first drive means for driving the needle bar comprises a rotary motor; the needle bar position detecting means comprises means for determining the rotational position of the needle bar drive motor; the second drive means for driving the looper comprises a rotary motor; and the looper position detecting means comprises means for determining the rotational position of the looper drive motor.

4. Apparatus as in claim 3, wherein the needle bar position detecting means and the looper position detecting means each comprise a semi-circular disk and means for detecting the presence of the disk.

5. Apparatus as in claim 4, wherein the disk presence detecting means comprise photoelectric detectors.

6. A sewing machine comprising a reciprocable needle bar movable between a top position and a lower position;

first drive means for driving the needle bar;

a looper movable into and out of a loop engaging position;

second drive means for driving the looper;

control means for initializing the starting positions of the needle bar and the looper to permit synchronized movement of the needle bar and the looper during a sewing operation; said control means comprising:

first means for initializing the needle bar toward the top position, the first initializing means including means for driving the needle bar in a reverse direction; and second means for initializing the looper away from a loop-engaging position.

7. Apparatus as in claim 6, wherein the control means includes means for enabling operation of the needle bar and the looper after the needle bar and looper are in a predetermined relationship with each other.

8. Apparatus as in claim 7, wherein the predetermined relationship between the needle bar and the looper is defined by the needle bar being near the top position and the looper being out of loop-engaging position.

9. Apparatus as in claim 8, wherein the control means includes means for enabling operation of the first initializing means before the second initializing means is enabled.

10. Apparatus as in claim 9, wherein the first initializing means comprises means for detecting the position of the needle bar; and the second initializing means includes means for detecting the position of the looper.

11. Apparatus as in claim 10, wherein the first and second drive means comprise rotary motors and the means for detecting the position of the needle bar and the means for detecting the position of the looper comprise means for detecting the rotational position of the respective motors.

12. A sewing machine comprising:

a reciprocable needle bar movable between a top position and a lower position;

a first drive means for driving the needle bar;

a looper;

a second drive means for driving the looper into and out of a loop-engaging position;

control means for controlling the first and second drive means, the control means comprising first means for initializing the starting position of the needle bar and second means for initializing the starting position of the looper;

the first initializing means comprising: means for detecting the position of the needle bar; means for determining if the detecting means indicates a position of the needle bar adjacent the top position, means for driving the needle bar adjacent the top position in response to a negative determination by the determining means and means to drive the needle bar in a reverse direction in response to a negative determination by the determining means;

the second initializing means comprising: means for detecting the position of the looper; means for determining if the detecting means indicates the looper is out-of-loop-engaging position; and means for driving the looper to an out of loop engagement position in response to a negative determination by the determining means; and said control means including means for enabling operation of the needle bar and the looper after completion of initialization by the first and second initializing means.

13. Apparatus as in claim 12, wherein the control means includes means for enabling the first initialization means before enabling the second initialization means.

14. Apparatus as in claim 3, wherein said controlling means includes initializing means for initializing the positional relationship between the needle bar and the looper into the predetermined relationship.

* * * * *